US010128560B2

(12) United States Patent
Heng

(10) Patent No.: US 10,128,560 B2
(45) Date of Patent: Nov. 13, 2018

(54) HYBRID ANTENNA AND INTEGRATED PROXIMITY SENSOR USING A SHARED CONDUCTIVE STRUCTURE

(71) Applicant: Ethertronics, Inc., San Diego, CA (US)

(72) Inventor: Chew Chwee Heng, Singapore (SG)

(73) Assignee: Ethertronics, Inc., San Diego, CA (US)

( * ) Notice: Subject to any disclaimer, the term of this patent is extended or adjusted under 35 U.S.C. 154(b) by 24 days.

(21) Appl. No.: 14/968,893

(22) Filed: Dec. 14, 2015

(65) Prior Publication Data

US 2016/0172749 A1 Jun. 16, 2016

Related U.S. Application Data

(60) Provisional application No. 62/090,887, filed on Dec. 12, 2014.

(51) Int. Cl.

| | |
|---|---|
| ***H01Q 1/52*** | (2006.01) |
| ***H01Q 1/24*** | (2006.01) |
| ***H01Q 1/44*** | (2006.01) |
| ***H01Q 9/42*** | (2006.01) |

(52) U.S. Cl.

CPC ..... *H01Q 1/243* (2013.01); *H01Q 1/44* (2013.01); *H01Q 9/42* (2013.01)

(58) Field of Classification Search

CPC ..... H01Q 1/243; H01Q 9/42; H01Q 1/44

See application file for complete search history.

(56) References Cited

U.S. PATENT DOCUMENTS

| | | | | |
|---|---|---|---|---|
| 6,111,503 | A | 8/2000 | Javitt et al. | |
| 6,166,694 | A | 12/2000 | Ying | |
| 6,326,921 | B1 | 12/2001 | Egorov et al. | |
| 6,339,402 | B1 | 1/2002 | McKivergan | |
| 7,003,519 | B1 | 2/2006 | Biettron et al. | |
| 7,113,087 | B1 | 9/2006 | Casebolt et al. | |
| 7,180,464 | B2 | 2/2007 | Chiang et al. | |
| 7,265,714 | B2 | 9/2007 | Goldberg | |
| 7,319,432 | B2 | 1/2008 | Andersson | |
| 7,372,406 | B2 | 5/2008 | Shiotsu et al. | |
| 7,425,924 | B2 | 9/2008 | Chung et al. | |
| 7,834,813 | B2 | 11/2010 | Caimi et al. | |
| 8,432,322 | B2 * | 4/2013 | Amm | H01Q 1/243 324/658 |
| 8,467,840 | B2 * | 6/2013 | Lin | H01Q 1/245 455/550.1 |
| 8,570,231 | B2 | 10/2013 | Desclos | |
| 8,577,289 | B2 | 11/2013 | Schlub et al. | |
| 8,928,540 | B2 | 1/2015 | Desclos et al. | |
| 9,030,361 | B2 | 5/2015 | Desclos et al. | |
| 9,190,733 | B2 | 11/2015 | Desclos et al. | |
| 9,478,870 | B2 | 10/2016 | Desclos et al. | |
| 9,502,768 | B2 | 11/2016 | Huang | |
| 2004/0233109 | A1 | 11/2004 | Ying et al. | |
| 2005/0264455 | A1 | 12/2005 | Talvitie et al. | |
| 2006/0017635 | A1 | 1/2006 | Zheng | |
| 2007/0241977 | A1 | 10/2007 | Vance | |

(Continued)

*Primary Examiner* — Jessica Han
*Assistant Examiner* — Michael Bouizza
(74) *Attorney, Agent, or Firm* — Dority & Manning, P.A.

(57) ABSTRACT

A hybrid antenna and integrated proximity sensor is described wherein a commonly shared conductive structure is used for both antenna functions as well as a proximity sensor functions.

16 Claims, 4 Drawing Sheets

(56) References Cited

U.S. PATENT DOCUMENTS

| | | | | |
|---|---|---|---|---|
| 2007/0268190 | A1 | 11/2007 | Huynh | |
| 2009/0051611 | A1 | 2/2009 | Shamblin et al. | |
| 2009/0224991 | A1 | 9/2009 | Rowson et al. | |
| 2012/0214412 | A1* | 8/2012 | Schlub ..... | G01B 7/023 455/41.1 |
| 2012/0299781 | A1 | 11/2012 | Lee | |
| 2013/0033400 | A1 | 2/2013 | Chiang | |
| 2013/0257666 | A1 | 10/2013 | Desclos et al. | |
| 2016/0043467 | A1 | 2/2016 | Desclos et al. | |

* cited by examiner

HYBRID ANTENNA AND INTEGRATED PROXIMITY SENSOR USING A SHARED CONDUCTIVE STRUCTURE

CROSS-REFERENCE TO RELATED APPLICATIONS

This application claims benefit of priority with U.S. Provisional Ser. No. 62/090,887, filed Dec. 12, 2014; the contents of which are hereby incorporated by reference.

BACKGROUND

Field of the Invention

This invention relates generally to the field of wireless communication; and more particularly, to wireless communication networks and antenna array techniques for interference suppression and multipath mitigation.

Description of the Related Art

Proximity sensors are in use today in commercial wireless devices as well as other product groups, and are used for a wide variety of applications. For example, it is common for a proximity sensor to be integrated into a cell phone, with the proximity sensor used to sense when the display region of the cell phone is in close proximity to an object. This sensing of an object being close to the display is used to reduce battery power consumption by turning off or down the brightness of the display when the display is in close proximity to a user's head or the display is covered by an object.

Another application of a proximity sensor is to integrate the sensor into a tablet computing device and use the sensor to sense proximity of the user's body to the tablet. When the user's body is close to the tablet, the transmit power of the cellular transceiver is reduced to allow the tablet to meet an acceptable threshold for Specific Absorption Rate (SAR).

One implementation of a proximity sensor is a capacitive sensor, and is effectively a parallel plate capacitor. A dielectric material is positioned between two plates of the capacitor to provide support and maintain a set separation distance between the plates. Two conductors are used to connect the two plates to a circuit that monitors capacitance. As objects are placed in proximity to the capacitor the objects interact with the fringing electric field emanating from the region between and external to the plates. This interference with the fringing fields of the capacitor translates into a change in capacitance, which can be detected.

SUMMARY OF THE INVENTION

A proximity sensor can be positioned beside or beneath an antenna and the antenna can be re-tuned to compensate for the effect of placing the metal conductors near the antenna. A more efficient method in terms of maintaining antenna performance, reducing volume required, and saving cost is to design the proximity sensor into the antenna structure. This combination antenna and proximity sensor will provide a more optimized and cost effective solution for devices that require antennas and proximity sensing systems. More importantly, by designing the proximity sensor, or multiple proximity sensors into the antenna, the ability to detect changes to the environment in the region of the antenna can be improved. This is important, since it is desirable to know when objects are positioned close to the antenna. Sensing when objects are in close proximity to an antenna can assist in re-tuning the antenna and keeping the antenna impedance optimized.

A hybrid antenna is disclosed herein which is configured to use a portion of the antenna structure itself as a sensing component (proximity sensor). Thus, the hybrid antenna conductor is used as an antenna and a sensing component. This hybrid antenna and sensing component is able to reduce the complexity of hybrid antenna design and also reduced the cost as no additional sensing component is needed.

The sensing circuit is coupled to the hybrid antenna/sensing component conductor through a low pass filter. The antenna transmitter/receiver is coupled to the hybrid antenna/sensing component conductor with a coax cable through a high pass or band pass filter. In this configuration, the conductor is capable of acting as both an antenna and a sensing component.

Traditionally in a tablet, two sensor pads are needed at two opposite sides of the antenna to detect object proximity. With this traditional two-sensor architecture there is a possibility that the detection is missed, for example, where the object is in between the two sensor pads. However, with the disclosed hybrid antenna and sensing component this detection will definitely not be missed as the antenna itself is also the sensor component.

DESCRIPTION OF EMBODIMENTS

In the following description, for purposes of explanation and not limitation, details and descriptions are set forth in order to provide a thorough understanding of the embodiments of the invention. However, it will be apparent to those skilled in the art that the present invention may be practiced in other embodiments, including certain variations or alternative combinations that depart from these details and descriptions. The following description is provided in order to enable those having skill in the art to make and use the preferred embodiment(s) of the invention.

Figure 1:
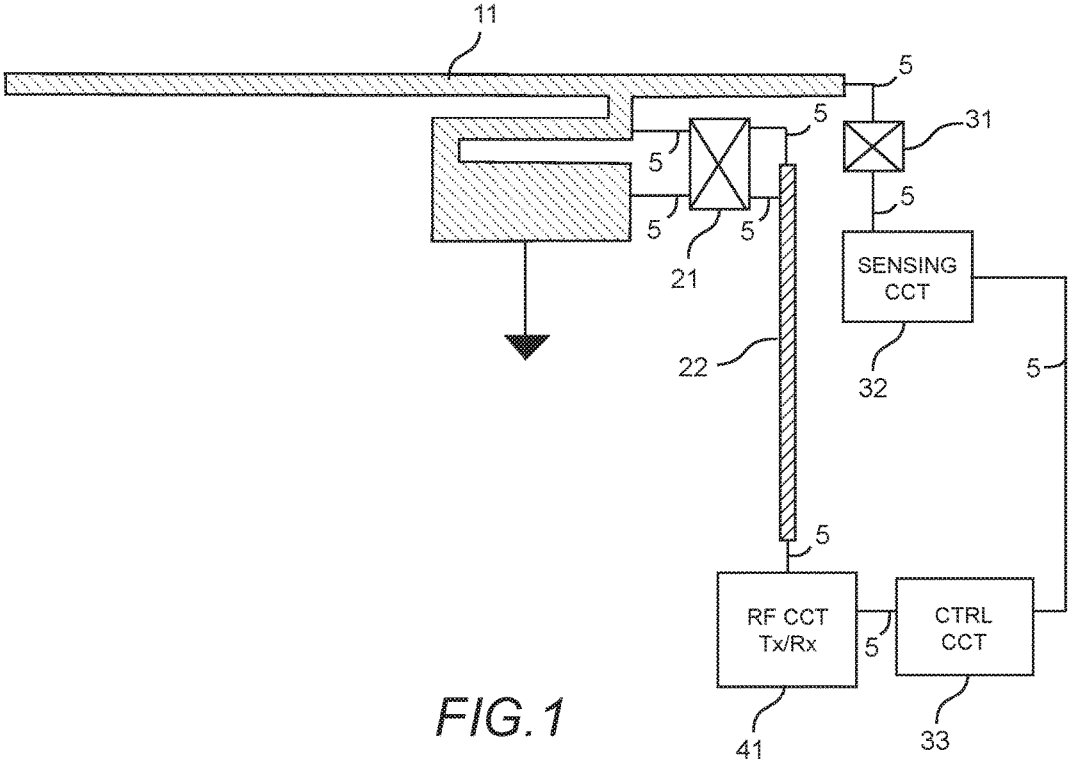
FIG. 1 shows a hybrid antenna and sensing component in accordance with an embodiment.

Now turning to the drawings, FIG. 1 shows a hybrid antenna and sensing component in accordance with an embodiment. The hybrid antenna and sensing component comprises an elongated conductor 11 coupled to a transceiver circuit 41 via a coaxial cable 22 extending therebetween. A first filter 21 is positioned between the elongated conductor 11 and the transceiver 41. The first filter 21 may include: a high pass filter, a band pass filter, or a combination thereof. The transceiver 41 (receiver, transmitter, or combination) is also coupled to a control circuit 33 which is further coupled to a sensing circuit 32. The sensing circuit 32 is further coupled to a low pass filter 31 and the elongated conductor 11. The filters 21; 31 are used to isolate radiofrequency (RF) signals from proximity signals. RF signals are typically between 700 MHz and 5 GHz, depending on the application (cellular, Wi-Fi, etc.). Proximity signals are typically about 100 KHz. Thus, the elongated conductor 11 is used as both an antenna and a sensing circuit, with the filters 21; 31 configured to separate the RF from proximity signals. Note the various components of the hybrid antenna and sensing component can be connected by a wire or trace 5 as shown.

Other alternative configurations may be implemented and readily appreciated by those having skill in the art.

Figure 2:
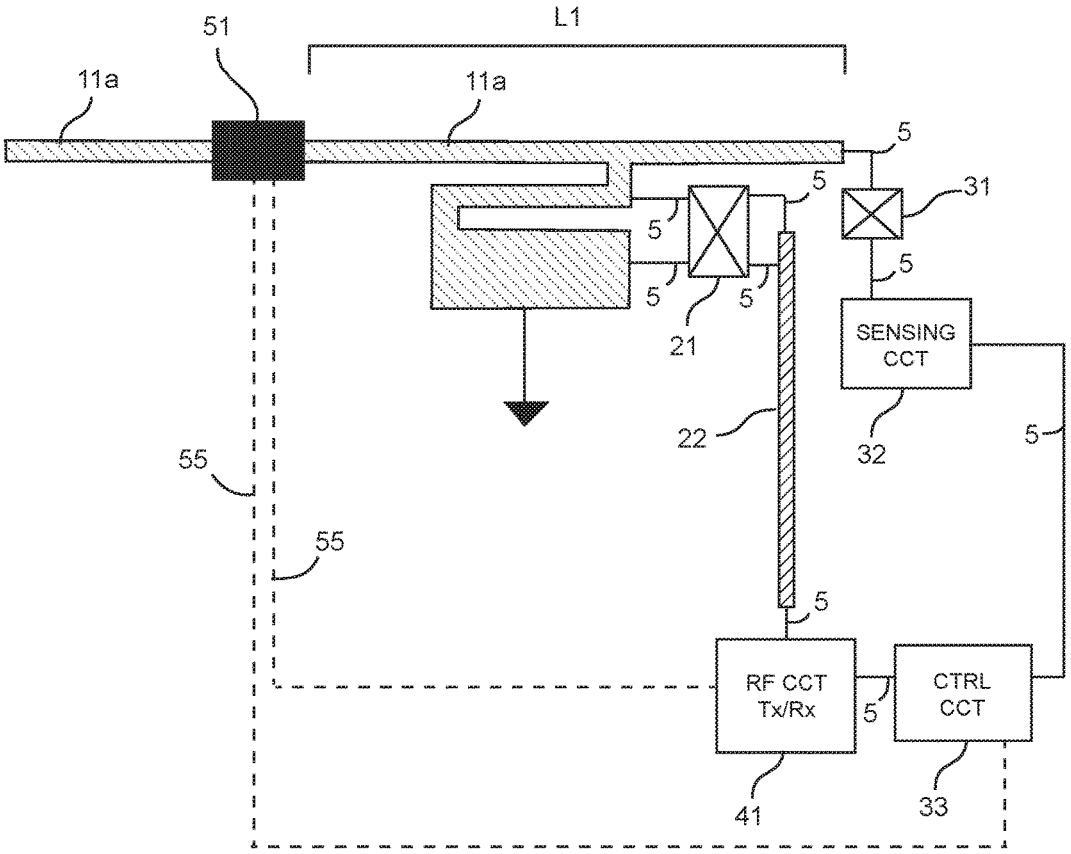
FIG. 2 shows a hybrid antenna and sensing component in accordance with another embodiment.

For example, FIG. 2 shows a hybrid antenna and sensing component in accordance with another embodiment. The antenna and sensing component is similar to that shown in FIG. 1, with the addition of a second high pass filter 51 (or other high pass circuit or active circuit) positioned on the elongated conductor for restricting the extent of the proximity sensor portion of the conductor. The conductor is shown having two portions, a first portion 11*a* and a second portion 11*b*. The second high pass filter 51 is positioned between the first and second portions of the elongated conductor. Here, the length of the sensing conductor is limited at the second high pass filter wherein the radiating antenna portion extends the entire length of the conductor 11*a*; 11*b* across the second high pass filter. Where the high pass filter is an active circuit, one or more optional control lines 55 (shown in broken lines) can be provided for controlling the circuit. The control lines can be coupled to one or both of the transceiver circuit and/or control circuit for actively configuring a length of the proximity sensor. Note that if the second high pass filter 51 is not an active circuit (ex: is a conventional high pass filter), only the high frequency signals will continue through the second high pass filter along the entire length of the elongated conductor. In this regard, the hybrid antenna and sensing component is configured such that the antenna utilizes the entire length of the elongated conductor whereas the sensing component utilizes only a portion (L1) of the elongated conductor.

Figure 3:
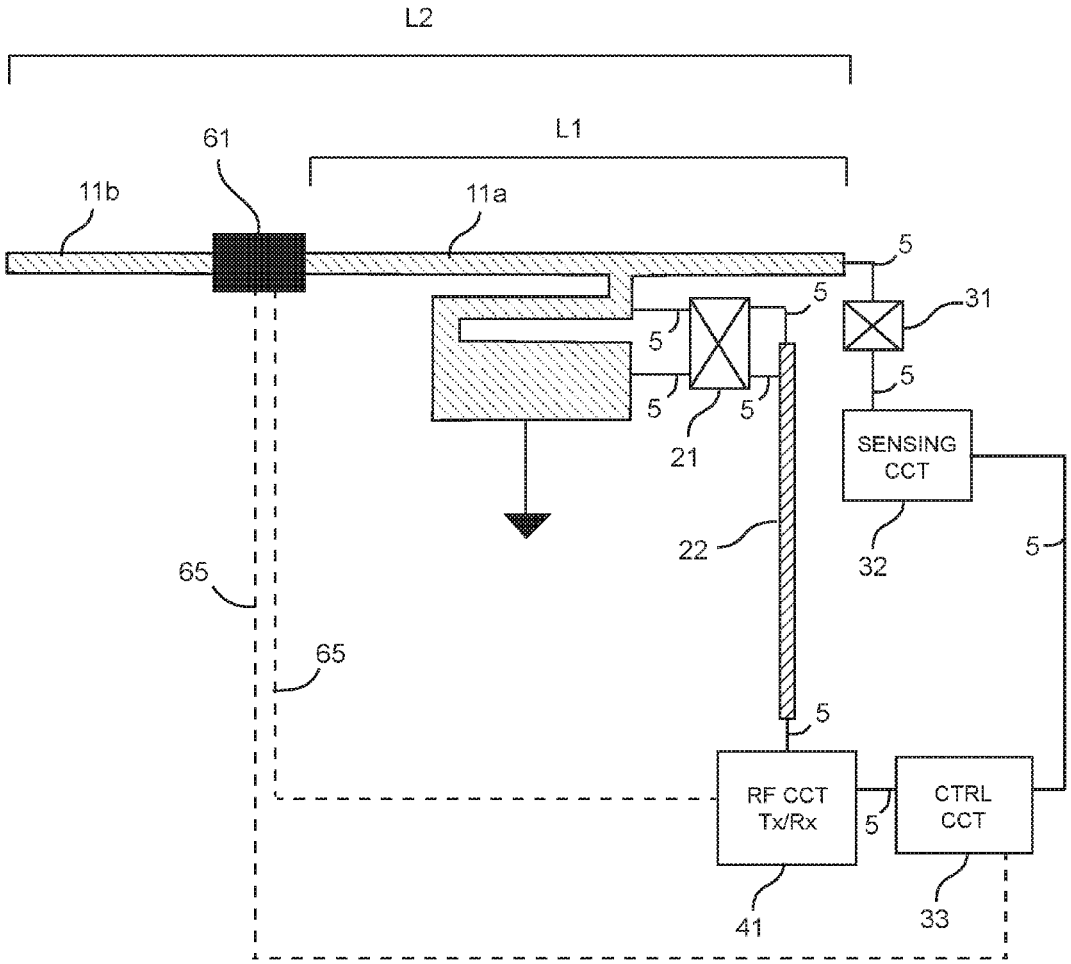
FIG. 3 shows a hybrid antenna and sensing component in accordance with another embodiment.

FIG. 3 shows a hybrid antenna and sensing component in accordance with another embodiment. The antenna is similar to that of FIG. 1 but further includes an active circuit 61 disposed between a first end and a second end of the elongated conductor. The active circuit is configured to restrict the extent of the sensor as a function of time by varying a reactance or switching to shorten a length of the elongated conductor from a second length L2 (11*a* plus 11*b*) to a first length L1 (11*a* only). In time slot A the length of the conductor extends from a first end to a second end (L2). However, in time slot B the length of the conductor extends from the active circuit 61 to the second end (L1). The active circuit can be controlled by one or more control lines 65 coupled to the transceiver circuit 41, control circuit 33, or both.

Figure 4:
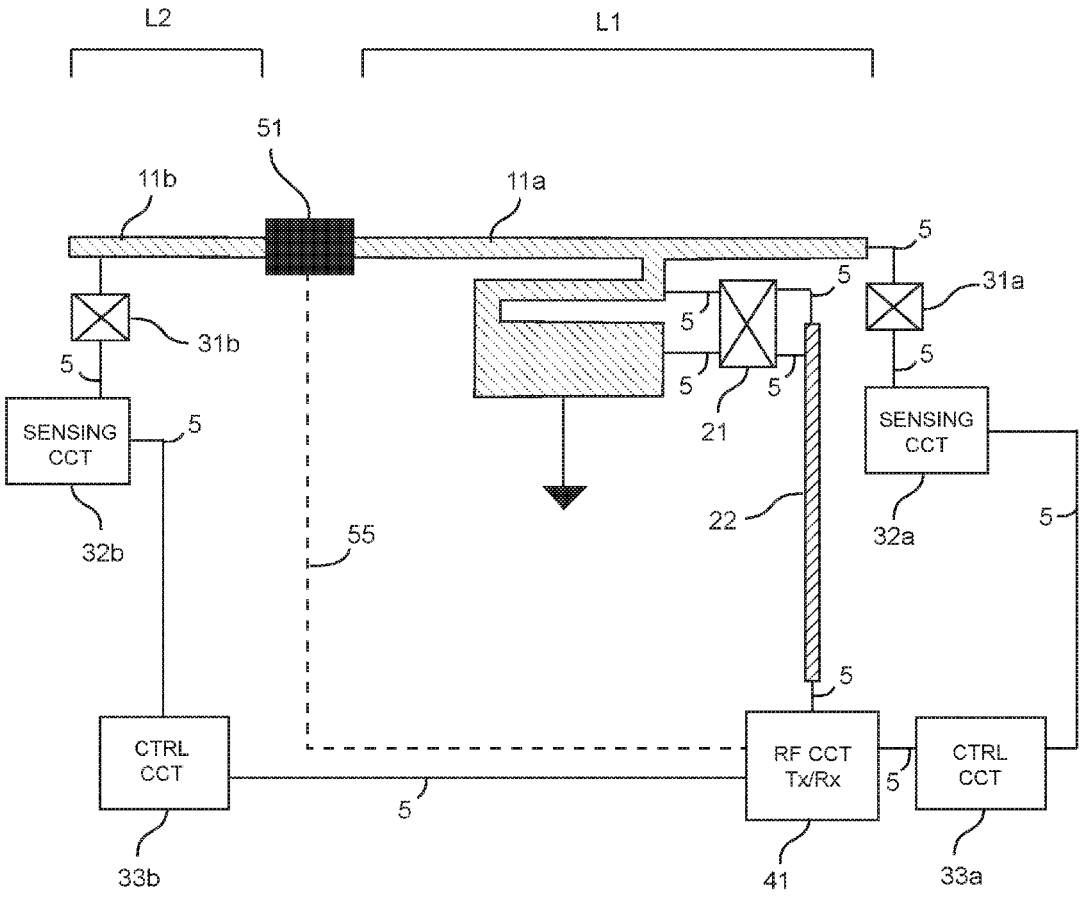
FIG. 4 shows a hybrid antenna and sensing component in accordance with yet another embodiment.

FIG. 4 shows a hybrid antenna and sensing component in accordance with yet another embodiment. Here, an elongated conductor having a first portion 11*a* and a second portion 11*b* is coupled to a transceiver circuit 41 using a coaxial cable 22. A first filter 21, including a high pass filter, band pass filter, or combination thereof, is positioned between the elongated conductor 11*a*; 11*b* and the transceiver 41. The elongated conductor is coupled to a first control circuit 33*a* at a first end thereof, wherein a first low pass filter 31*a* and a first sensing circuit 32*a* are disposed between the first end of the elongated conductor 11*a* and the first control circuit 33*a* along the transmission path or trace 5. The elongated conductor is further coupled to a second control circuit 33*b* at a second end thereof, wherein a second low pass filter 31*b* and a second sensing circuit 32*b* are each disposed between the second portion of the elongated conductor 11*b* and the second control circuit 33*b* along the transmission path or trace. Each of the first and second control circuits 33*a*; 33*b* is coupled to the transceiver circuit 41. A second high pass filter 51 (or high pass circuit or active circuit) is positioned along the conductor between the first and second portions 11*a*; 11*b*, respectively. In this regard, the antenna and sensing component comprises two distinct sensing sections on either side of the second high pass circuit 51 (or active circuit). RF signals and proximity signals are filtered using the high pass and low pass filters as shown. The result is a hybrid antenna and sensing component with two distinct sensors configured to share a volume of the antenna. Where the second high pass filter includes an active circuit, control signals can be sent from the transceiver circuit (or other control circuit) through an optional control line 55. Where the second high pass filter is a conventional filter, no control line is required.

While various embodiments and arrangements have been illustrated, it should be recognized by those having skill in the art that other variations and alternative arrangements of the disclosed features and embodiments can be similarly implemented to obtain an antenna with integrated sensing component. Accordingly, the above descriptions are not intended to limit the spirit and scope of the invention as set forth in the claims.

The invention claimed is:

1. An antenna and integrated sensing component, comprising:

an elongated conductor extending from a first end to a second end, the elongated conductor having a first portion associated with a first length and a second portion associated with a second length;

the elongated conductor being coupled to a transceiver circuit, wherein a first filter circuit is disposed between the elongated conductor and the transceiver circuit, said first filter circuit comprising a high-pass filter or a band-pass filter;

the first end of the elongated conductor being further coupled to a first sensing circuit, wherein a second filter circuit is disposed between the elongated conductor and the first sensing circuit, said second filter circuit comprising a low-pass filter; and the first sensing circuit being further coupled to the transceiver circuit, wherein a control circuit is disposed between the sensing circuit and the transceiver circuit;

wherein a second high-pass circuit is disposed along a length of the elongated conductor between the first and second ends thereof such that the second high-pass circuit is disposed between the first portion of the elongated conductor and the second portion of the elongated conductor, the length being a largest dimension of the elongated conductor;

wherein the antenna is configured to utilize a total length of the elongated conductor extending between the first end and the second end, the total length including the first length of the elongated conductor and the second length of the elongated conductor, and wherein the integrated sensing component is configured to utilize the first length of the elongated conductor extending between the first end and the second high-pass circuit.

2. The antenna of claim 1, wherein said first filter circuit comprises a high pass filter and a band pass filter.

3. An antenna and integrated sensing component, comprising:

a single elongated conductor extending from a first end to a second end;

the elongated conductor being coupled to a transceiver circuit, wherein a first filter circuit is disposed between the elongated conductor and the transceiver circuit, said first filter circuit comprising a high-pass filter or a band-pass filter;

the first end of the elongated conductor being further coupled to a first sensing circuit, wherein a second filter circuit is disposed between the elongated conductor and the first sensing circuit, said second filter circuit comprising a low-pass filter; and the first sensing circuit being further coupled to the transceiver circuit, wherein a control circuit is disposed between the sensing circuit and the transceiver circuit;

wherein an active circuit is disposed between the first and second ends of the single elongated conductor;

wherein the antenna is configured to utilize a length of the conductor from the first end to the second end, and wherein the integrated sensing component is configured to utilize each of: (i) a first length of the conductor extending between the first end and the second end with the active circuit in a first mode, and (ii) a second length of the conductor extending between the active circuit and the second end with the active circuit in a second mode.

4. The antenna of claim 3, wherein the sensing component is configured to vary a length thereof as a function of time by varying a mode of the active circuit.

5. An antenna and integrated sensing component, comprising:

an elongated conductor having a first portion and a second portion forming a length thereof, the length being the longest dimension of the elongated conductor;

the elongated conductor coupled to each of: a first filter circuit, a coaxial cable, and a transceiver circuit along a first path, said transceiver circuit including a receiver, transmitter, or a combination thereof, and said first filter circuit including a first high-pass filter or a band pass filter; and the elongated conductor further coupled to a first low-pass filter, a first sensing circuit, and a first control circuit along a second path, the control circuit being further coupled to the transceiver circuit;

characterized in that the antenna and integrated sensing component further comprises one of:

a second high-pass filter, or an active circuit, the second high-pass filter or active circuit being disposed between said first and second portions of the elongated conductor such that the second high-pass filter or active circuit divides the length of the elongated conductor into the first portion and the second portion.

6. The antenna and integrated sensing component of claim 5, wherein the first filter circuit comprises a first high pass filter and a band pass filter.

7. The antenna and integrated sensing component of claim 5, wherein said antenna and integrated sensing component comprises an active circuit disposed between said first and second portions of the elongated conductor; wherein the active circuit is configured to vary a length of the elongated conductor for actively changing sensing signals and radiofrequency (RF) signals associated with the elongated conductor.

8. The antenna and integrated sensing component of claim 7, wherein said active circuit is coupled to the transceiver circuit, control circuit, or a combination thereof, for receiving control signals adapted to control a mode of the active circuit.

9. The antenna and integrated sensing component of claim 8, further comprising: a second low pass filter, second sensing circuit, and second control circuit each disposed along a third path and coupled to the transceiver circuit; wherein the first low pass filter, first sensing circuit, and first control circuit of the second path are coupled to the first portion of the elongated conductor; and wherein the second low pass filter, second sensing circuit, and second control circuit of the third path are coupled to the second portion of the elongated conductor.

10. The antenna and integrated sensing component of claim 9 configured to provide a first sensing component defined by the first portion of the elongated conductor coupled to the second path; a second sensing component defined by the second portion of the elongated conductor coupled to the third path; and an antenna defined by the first and second portions and active circuit coupled therebetween, wherein the active circuit is configured to vary a length of the elongated conductor for varying a mode of the antenna.

11. The antenna and integrated sensing component of claim 10 further configured to provide a third sensing component defined by the first and second portions of the elongated conductor being coupled by the active circuit for combining the electrical length thereof.

12. The antenna and integrated sensing component of claim 5, wherein the first path is configured to communicate radiofrequency (RF) signals between the elongated conductor and transceiver circuit for providing an antenna function of the antenna and integrated sensing component.

13. The antenna and integrated sensing component of claim 5, wherein the second path is configured to communicate sensing signals between the elongated conductor and the control circuit for providing a sensing function of the antenna and integrated component.

14. The antenna and integrated sensing component of claim 5, wherein said antenna and integrated sensing component comprises a high pass filter disposed between said first and second portions of the elongated conductor; wherein the high pass filter is configured to filter sensing signals and pass radiofrequency (RF) signals between the first and second portions of the elongated conductor.

15. The antenna and integrated sensing component of claim 14, further comprising: a second low pass filter, second sensing circuit, and second control circuit each disposed along a third path and coupled to the transceiver circuit; wherein the first low pass filter, first sensing circuit, and first control circuit of the second path are coupled to the first portion of the elongated conductor; and wherein the second low pass filter, second sensing circuit, and second control circuit of the third path are coupled to the second portion of the elongated conductor.

16. The antenna and integrated sensing component of claim 15 configured to provide a first sensing component defined by the first portion of the elongated conductor coupled to the second path; a second sensing component defined by the second portion of the elongated conductor coupled to the third path; and an antenna defined by the first and second portions and high pass filter coupled therebetween.

* * * * *